US006618967B2

(12) United States Patent
Satzler et al.

(10) Patent No.: US 6,618,967 B2
(45) Date of Patent: Sep. 16, 2003

(54) WORK MACHINE CONTROL FOR IMPROVING CYCLE TIME

(75) Inventors: Ronald L. Satzler, Princeville, IL (US); Michael I. Cline, Metamora, IL (US)

(73) Assignee: Caterpillar Inc, Peoria, IL (US)

( * ) Notice: Subject to any disclaimer, the term of this patent is extended or adjusted under 35 U.S.C. 154(b) by 14 days.

(21) Appl. No.: 10/025,782

(22) Filed: Dec. 26, 2001

(65) Prior Publication Data

US 2003/0115779 A1 Jun. 26, 2003

(51) Int. Cl.[7] ..... E02F 5/02

(52) U.S. Cl. ..... 37/348; 37/195; 701/50

(58) Field of Search ..... 37/348, 332, 902, 37/195, 443; 701/50; 414/699, 700; 172/2, 4.5

(56) References Cited

U.S. PATENT DOCUMENTS

| | | | | |
|---|---|---|---|---|
| 5,062,264 A | | 11/1991 | Frenette et al. | |
| 5,065,326 A | | 11/1991 | Sahm | |
| 5,442,868 A | * | 8/1995 | Ahn | 37/348 |
| 5,446,980 A | * | 9/1995 | Rocke | 37/348 |
| 5,493,798 A | * | 2/1996 | Rocke et al. | 37/348 |
| 5,528,498 A | * | 6/1996 | Scholl | 701/50 |
| 5,768,810 A | * | 6/1998 | Ahn | 37/348 |
| 5,794,369 A | | 8/1998 | Lee et al. | |
| 5,835,874 A | | 11/1998 | Hirata et al. | |
| 5,903,988 A | * | 5/1999 | Tochizawa et al. | 37/348 |
| 5,968,103 A | * | 10/1999 | Rocke | 701/50 |
| 6,025,686 A | * | 2/2000 | Wickert et al. | 318/568.18 |
| 6,052,636 A | * | 4/2000 | Lombardi | 701/50 |
| 6,064,933 A | * | 5/2000 | Rocke | 701/50 |
| 6,076,030 A | | 6/2000 | Rowe | |
| 6,140,787 A | * | 10/2000 | Lokhorst et al. | 318/568.18 |
| 6,321,153 B1 | * | 11/2001 | Rocke et al. | 701/50 |

FOREIGN PATENT DOCUMENTS

| | | | |
|---|---|---|---|
| EP | 0 735 202 A1 | | 10/1996 |
| JP | 9-71965 | * | 3/1997 |
| JP | 9-256407 | * | 9/1997 |
| JP | 9-296482 | * | 11/1997 |
| JP | 10-67432 | * | 3/1998 |
| WO | WO 98/03738 | | 1/1998 |

* cited by examiner

*Primary Examiner*—Victor Batson
(74) *Attorney, Agent, or Firm*—Finnegan, Henderson, Farabow, Garrett & Dunner

(57) ABSTRACT

A method and system for controlling a work implement having a ground engaging tool is provided. A swing command is supplied to a swing assembly to move the ground engaging tool in an arcuate path about a vertical axis. A crowd command is determined based on the velocity of the swing assembly and is calculated to generate a resulting net movement of the ground engaging tool toward a predetermined end point. The crowd command is supplied to a crowd mechanism to move the ground engaging tool towards the predetermined end point.

20 Claims, 4 Drawing Sheets

WORK MACHINE CONTROL FOR IMPROVING CYCLE TIME

TECHNICAL FIELD

The present invention is directed to a control system for a work machine. More particularly, the present invention is directed to a system and method for controlling a work implement to improve the cycle time of a work machine.

BACKGROUND

Work machines are commonly used to move large amounts of earth or other material in an excavation or dredging operation. These work machines typically include a work implement that is designed to pick up a load of earth or other material from one location and drop off the load at a second location. For example, an excavator may include a work implement that has a ground engaging tool, such as a bucket or a clamshell. An operator may control the motion of the ground engaging tool to pick up a load of earth from an excavation site. The operator may then move the ground engaging tool to a dumping location, where the load of earth may be unloaded to a removal vehicle.

These work machines are commonly powered by hydraulic systems, which may use pressurized fluid to both move the work implements and to move the machine. The hydraulic systems typically include a series of hydraulic actuators, such as, for example, hydraulic cylinders or fluid motors. The movement of these hydraulic actuators may be controlled by controlling the rate and direction of fluid flow into and out of the hydraulic actuator. Typically, a series of hydraulic actuators are distributed throughout the work machine to transmit the power required to move the work machine and the work implement. By controlling the rate and direction of fluid flow into the hydraulic actuators, the movement of the work machine and of the work implement may be controlled.

During an excavation or dredging type operation, an operator will often guide the work machine through a repetitive sequence of steps. For example, in an excavation operation, an operator of a work machine will move the ground engaging tool to a loading, location where the ground engaging tool picks up a load of earth. The operator will then lift the ground engaging tool and move it to a dumping location where the load is unloaded to a removal vehicle. The operator will then return the ground engaging tool to the loading location to pick up a new load of earth. The time taken to complete this sequence of steps may be referred to as the cycle time for the particular operation.

One measure of the efficiency of the work machine may be defined by the amount of material moved during a given period time. Any reduction in the amount of time required to complete a cycle will likely result in an increase in the amount of material moved during a period of time. Thus, a reduction in cycle time may result in an increase in the efficiency of the work machine.

As described in U.S. Pat. No. 5,446,980, one approach to improving the efficiency of a work machine is to automate control of the work implement. In this approach, an automated control system governs the movement of the work implement to perform a particular task with minimal input from an operator. This type of automated control may improve the efficiency of the work machine as the automated control may remain consistently productive, regardless of prolonged hours and environmental considerations.

However, these types of automated control systems do not directly address the issue of reducing cycle time. The automated control systems are typically programmed to guide a work machine through a work cycle in the same way an operator would. Consider, for example, an excavation operation where the work machine has to move the ground engaging tool through a large rotation to move from a loading location to a dumping location. Typically, an operator or an automated control system will move the ground engaging tool from the loading location to the dumping location by actuating a swing assembly on the work machine to pivot the ground engaging tool. The pivoting motion results in the ground engaging tool moving along an arcuate path between the loading and dumping locations. The operator or automated control system will then return the ground engaging tool to the loading location through a similar arcuate pattern. However, these arcuate paths will not typically represent the shortest possible path between the two locations. By moving the ground engaging tool along these arcuate paths, the work machine expends more time than necessary to complete a work cycle, which may result in a decreased efficiency.

The control system of the present invention solves one or more of the problems set forth above.

SUMMARY OF THE INVENTION

One aspect of the present invention is directed to a method for controlling a work implement having a ground engaging tool. A swing command is supplied to a swing assembly to move the ground engaging tool about a vertical axis. A crowd command is determined based on the velocity of the swing assembly. The crowd command is calculated to generate a resulting net movement of the ground engaging tool toward a predetermined end point. The crowd command is supplied to a crowd mechanism to move the ground engaging tool towards the predetermined end point.

In another aspect, the present invention is directed to a control system for a work implement having a ground engaging tool. The control system includes a memory configured to store a location of a predetermined end point. A position sensing system is operatively connected to the work implement and is configured to provide an indication of a current position of the ground engaging tool. A control is configured to determine a travel path having a horizontal component path connects the current position of the ground engaging tool with the predetermined end point. At least a portion of the horizontal component of the travel path substantially coincides with a straight line connecting the current position of the ground engaging tool with the predetermined end point. The control is further configured to control the movement of the ground engaging tool to move the ground engaging tool along the travel path to the predetermined end point.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments of the invention and together with the description, serve to explain the principles of the invention. In the drawings.

DETAILED DESCRIPTION

Reference will now be made in detail to exemplary embodiments of the invention, examples of which are illustrated in the accompanying drawings. Wherever possible, the same reference numbers will be used throughout the drawings to refer to the same or like parts.

Figure 1:
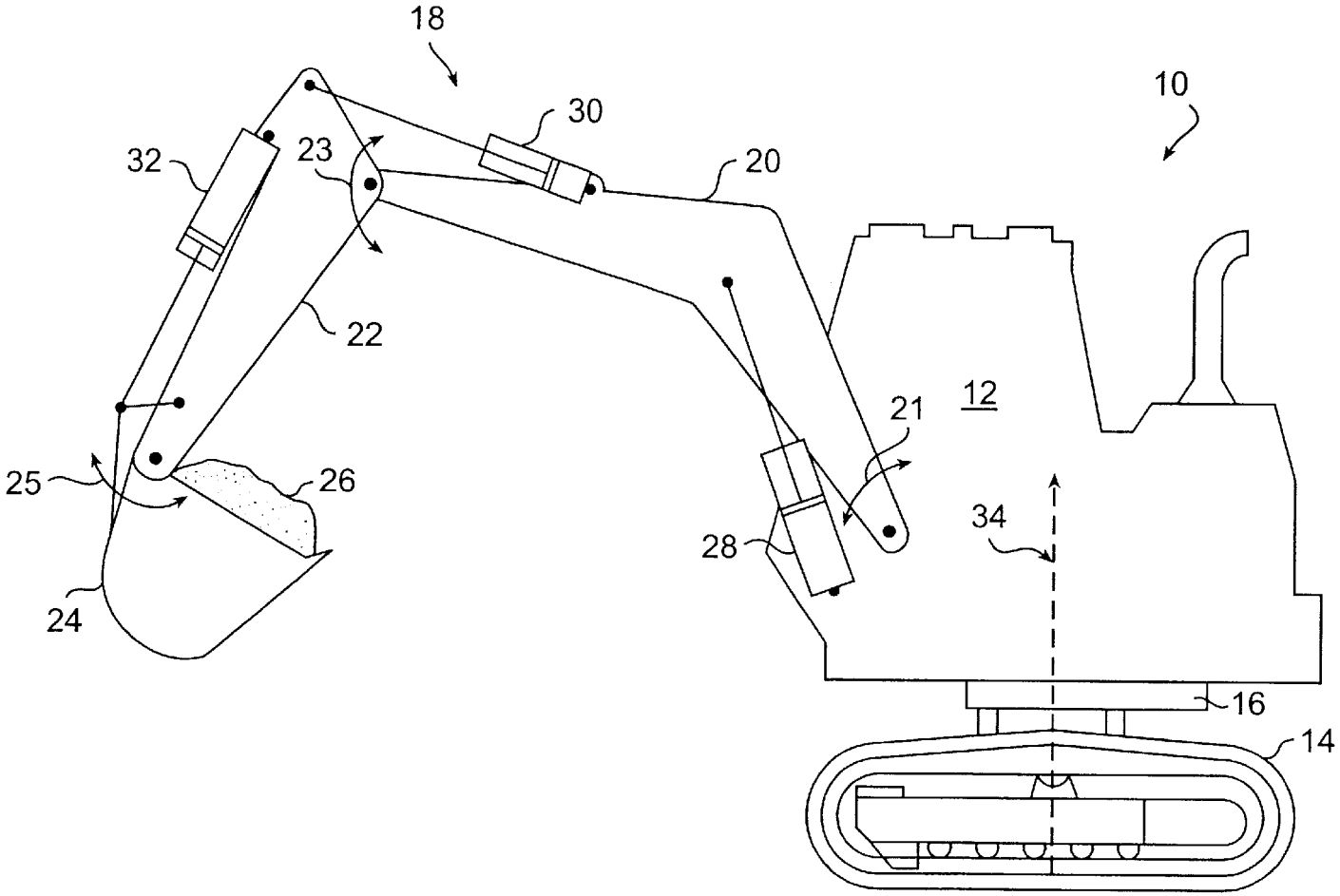
FIG. 1 is a side view of a work machine having a work implement in accordance with one exemplary embodiment of the present invention.

An exemplary embodiment of a work machine 10 is illustrated in FIG. 1. Work machine 10 may be any type of material moving machinery that includes a swing element. For example, work machine 10 may be an excavator or a backhoe.

As illustrated in FIG. 1, work machine 10 includes a housing 12 that may include a seating area for an operator. Housing 12 is mounted on a swing assembly 16 that is configured to rotate or pivot housing 12 about a vertical axis 34. Swing assembly 16 may include a hydraulic actuator, such as, for example, a fluid motor or a hydraulic cylinder, that pivots housing 12 about vertical axis 34. Pressurized fluid may be introduced to swing assembly 16 to move swing assembly 16. The direction and rate of the introduced flow of pressurized fluid governs the direction of movement of swing assembly 16.

Housing 12 and swing assembly 16 are supported by a traction device 14. Traction device 14 may be any type of device that is capable of providing a stable support for work machine 10 when work machine 10 is in operation. In addition, traction device 14 may provide for movement of work machine 10 around a job site and/or between job sites. For example, traction device 14 may be a wheel base or a track base. In addition, traction device may be a water-based vessel such as, for example, a barge.

As further illustrated in FIG. 1, work machine 10 includes a work implement 18. Work implement 18 includes a crowd mechanism, which may include a boom 20 and a stick 22, and a ground engaging tool 24. Ground engaging tool 24 may be any type of mechanism commonly used on a work machine to move a load 26 of earth, debris, or other material. For example, ground engaging tool 24 may be a bucket or a clamshell.

Boom 20 of the crowd mechanism may be pivotally mounted on housing 12 for movement in the directions indicated by arrow 21. In another exemplary embodiment, boom 20 may be mounted directly on swing assembly 16 and housing 12 may be fixed relative to traction device 14. In this alternative embodiment, swing assembly 16 would allow boom to pivot about a vertical axis relative to housing 12.

A boom actuator 28 may be connected between boom 20 and housing 12 or between boom 20 and swing assembly 16. Boom actuator 28 may be one or more hydraulically powered actuators, such as, for example, fluid motors or hydraulic cylinders. Alternatively, boom actuator 28 may be any other device readily apparent to one skilled in the art as capable of moving boom 20 relative to housing 12. Pressurized fluid may be introduced to boom actuator 28 to move boom 20 relative to housing 12. The direction and rate of the pressurized fluid flow to boom actuator 28 may be controlled to thereby control the direction and speed of movement of boom 20.

Stick 22 is pivotally connected to one end of boom 20 for movement in the directions indicated by arrow 23. A stick actuator 30 may be connected between stick 22 and boom 20. Stick actuator 30 may be one or more hydraulically powered actuators, such as, for example, fluid motors or hydraulic cylinders. Alternatively, stick actuator 22 may be any other device readily apparent to one skilled in the art as capable of moving stick 22 relative to boom 20. Pressurized fluid may be introduced to stick actuator 30 to move stick 22 relative to boom 20. The direction and rate of the pressurized fluid flow to stick actuator 30 may be controlled to thereby control the direction and speed of movement of stick 22.

Ground engaging tool 24 is pivotally connected to one end of stick 22 for movement in the directions indicated by arrow 25. A tool actuator 32 may be connected between ground engaging tool 24 and stick 22. Tool actuator 32 may be one or more hydraulically powered actuators, such as, for example, fluid motors or hydraulic cylinders. Alternatively, tool actuator 32 may be any other appropriate device readily apparent to one skilled in the art as capable of moving ground engaging tool 24 relative to stick 22. Pressurized fluid may be introduced to tool actuator 22 to move ground engaging tool 24 relative to stick 22. The direction and rate of the pressurized fluid flow to tool actuator 32 may be controlled to thereby control the direction and speed of movement of ground engaging tool 24 relative to stick 22.

Figure 2:
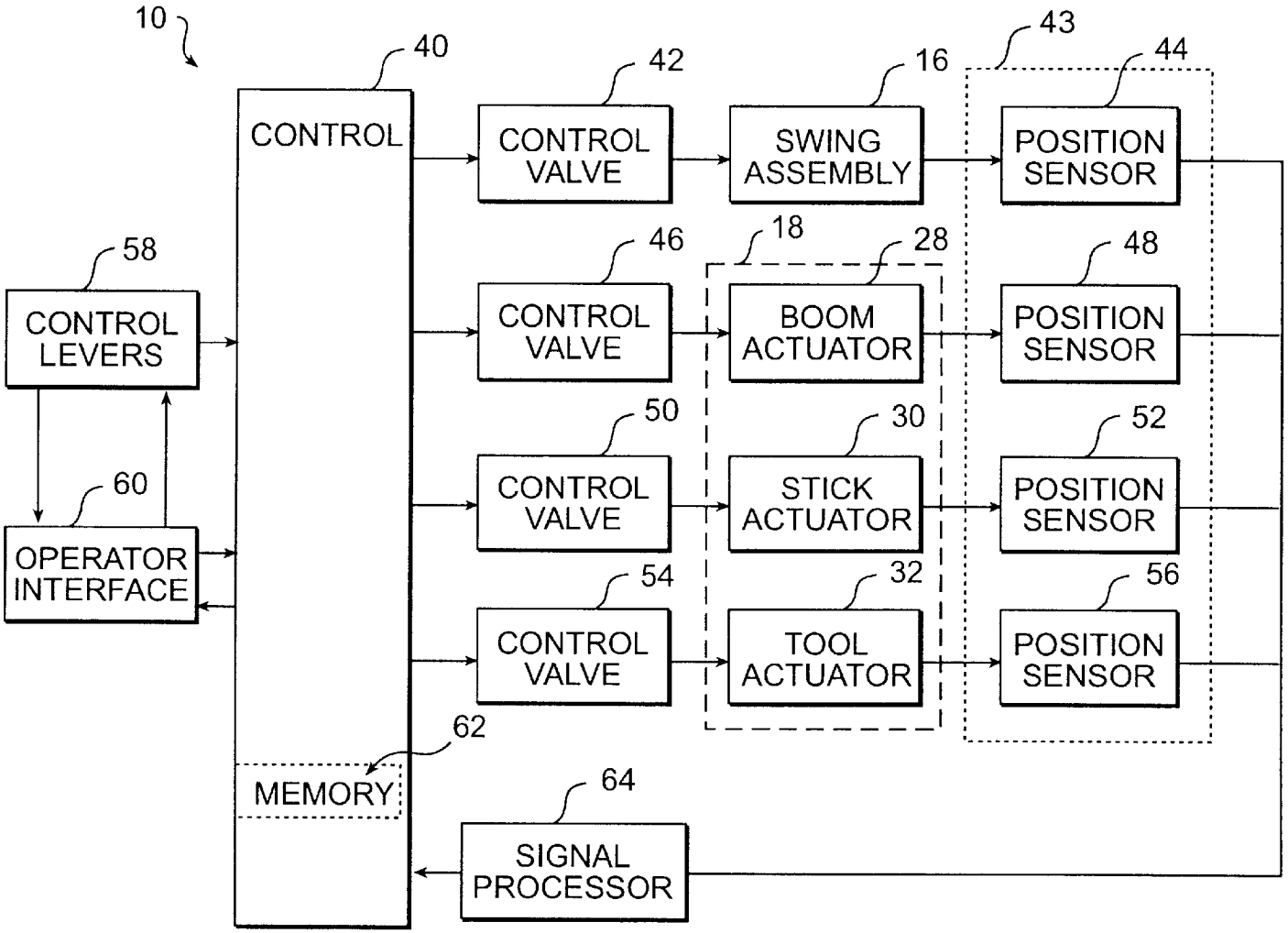
FIG. 2 is a block diagram of an exemplary embodiment of a work machine control in accordance with an exemplary embodiment of the present invention.

As diagrammatically illustrated in FIG. 2, work machine 10 may include a control 40. Control 40 may include a computer, which has all the components required to run an application, such as, for example, a memory 62, a secondary storage device, a processor, such as a central processing unit, and an input device. One skilled in the art will appreciate that this computer can contain additional or different components. Furthermore, although aspects of the present invention are described as being stored in memory, one skilled in the art will appreciate that these aspects can also be stored on or read from other types of computer program products or computer-readable media, such as computer chips and secondary storage devices, including hard disks, floppy disks, CD-ROM, or other forms of RAM or ROM.

As further illustrated in FIG. 2, control 40 is operatively connected to a series of control valves 42, 46, 50, and 54. Control valve 42 is disposed in a fluid line leading to swing assembly 16. Control valve 46 is disposed in a fluid line leading to boom actuator 28. Control valve 50 is disposed in a fluid line leading to stick actuator 30. Control valve 54 is disposed in a fluid line leading to tool actuator 32.

Each control valve 42, 46, 50, and 54 is configured to control the rate and direction of fluid flow to the chambers of a hydraulic actuator. For example, control valve 42 controls the rate and direction of the fluid flow to swing assembly 16. Similarly, control valves 46, 50, and 54 control the rate and direction of fluid flow to boom actuator 28, stick actuator 30, and tool actuator 32, respectively. Each control valve 42, 46, 50, and 54 may be, for example, a directional control valve such as a set of four independent metering valves. Alternatively, each control valve 42, 46, 50 and 54 may be a spool valve, a split-spool valve, or any other mechanism configured to control the rate and direction of a fluid flow into and out of a hydraulic actuator.

Control 40 is configured to control the relative positions of control valves 42, 46, 50, and 54 to thereby control the rate and direction of fluid flow to the respective hydraulic actuators. By controlling the rate and direction of fluid flow through control valves 42, 46, 50, and 54, control 40 may control the rate and direction of movement of swing assembly 16, boom 20, stick 22, and ground engaging tool 24. In this manner, control 40 may control the overall rate and direction of movement of work implement 18.

As illustrated in FIG. 2, work machine 10 may include a position sensing system 43 that provides information on the position of work implement 18. Position sensing system 43 may include a series of rotation and displacement sensors as described below. Alternatively, position sensing system 43 may be any system readily apparent to one skilled in the art as capable of tracking the position of ground engaging tool 24.

In one exemplary embodiment, position sensing system 43 may include a position sensor 44 that is operatively connected to swing assembly 16 to determine the relative position of swing assembly 16. Position sensor 44 may be configured to measure the angle of rotation of swing assembly 16 relative to vertical axis 34. This will allow control 40 to determine the direction in which boom 20 is extending from work machine 10.

In addition, position sensing system 43 may include a series of position sensors 48, 52, and 56 that are connected to boom actuator 28, stick actuator 30, and tool actuator 32. Each of position sensors 48, 52, and 56 may be configured to measure the relative displacement of the respective actuator, i.e. to determine the distance that the actuator is extended. This will allow control 40 to determine the position of the work implement element being moved by the particular actuator.

As will be apparent to one skilled in the art, by knowing the displacement of the actuators, the position of boom 20, stick 22, and ground engaging tool 24 relative to housing 12 may be determined through straightforward trigonometric calculations. Position sensing system 43 transmits this positional information to control 40. A signal processor 64 may be included to condition the position signals. Thus, position sensing system 43 provides the information required for control 40 to calculate the current position of ground engaging tool 24. Control 40 may use the positional information to determine the velocity, direction, and acceleration rate of ground engaging tool 24.

Control 40 may receive movement instructions from an operator and/or an automated control program. For example, an operator may manipulate a set of control levers 58 to provide the movement instructions. The set of control levers 58 may include, for example, one lever to control the motion of each of swing assembly 16, boom 20, stick 22, and ground engaging tool 24. By selectively moving the set of control levers 58, an operator may individually and selectively control the rate and direction of movement of each of swing assembly 16, boom 20, stick 22, and ground engaging tool 24. Thus, by coordinating movement of control levers 58, the operator may control motion of work implement 18.

Alternatively, control 40 may include an automated program that provides movement instructions for work implement 18 to guide work implement 18 throughout an entire work cycle. An operator interface 60 may be provided to allow an operator to input information to control 40 that details the parameters of the particular operation. For example, an operator may enter in the coordinates and parameters of a working location and a dumping location, as well as information relating to the time and sequence of the operation. Based on this information, control 40 may automatically move ground engaging tool 24 to a loading location to retrieve a load of earth, move ground engaging tool 24 to a dumping location to unload the earth, and then return the ground engaging tool 24 to the loading location to retrieve another load.

Figure 3:
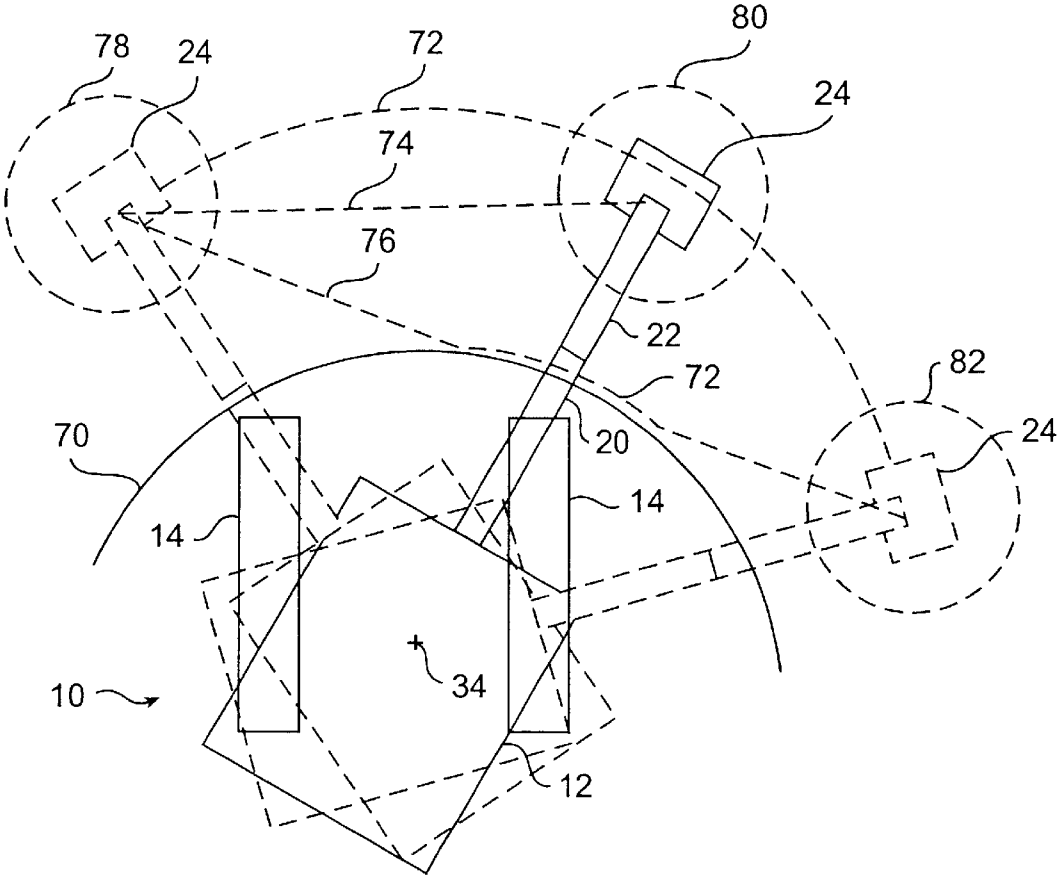
FIG. 3 is a diagrammatic top view of the exemplary work machine of FIG. 1, illustrating movement of the work implement between a loading location and a dumping location.

During operation of work machine 10, either under automated control or under operator control, work implement 18 will often be repetitively moved to a dumping location. An exemplary work site, which may be, for example, an excavation or dredging site, is illustrated in FIG. 3. As diagrammatically illustrated in FIG. 3, a work cycle may begin when work machine 10 positions ground engaging tool 24 at position 80. Work implement 18 may then be operated in a loading sequence where ground engaging tool 24 picks up a load 26 of earth. The loading sequence may be performed by an operator or under the guidance of an automated control system.

Once ground engaging tool 24 is loaded, the next step in the work cycle is to move ground engaging tool 24 to a predetermined end point, which may be, for example, a dumping location 78. Dumping location 78 may be defined, for example, by a debris removal vehicle such as, for example, a dump truck or a waste removal barge. The coordinates of dumping location 78 relative to work machine 10 may be communicated to control 40 by inputting the coordinates of dumping location 78 through operator interface 60. Alternatively, prior to beginning work, ground engaging tool 24 may be positioned at dumping location 78 and an appropriate instruction transmitted to control 40 to save the current position of ground engaging tool 24 in memory 62 as the location of dumping location 78.

An instruction to move ground engaging tool 24 from a current position 80 to dumping location 78 may be initiated by an operator or by the automated control program. For example, an operator may initiate the move to dumping location 78 by depressing a button. The instruction may also be generated by another type of indication, such as, for example, when the operator moves a swing assembly control lever past a certain point to indicate that maximum, or near maximum, swing is desired.

When the instruction is received, control 40 will supply a swing command to swing assembly 16. In response to the swing command, swing assembly 16 will move ground engaging tool 24 and the associated load 26 in an arcuate path 72 about vertical axis 34. The velocity at which swing assembly 16 moves ground engaging tool 24 along arcuate path 72 may depend upon the instruction received from the operator and/or the automated control system.

Control 40 may also determine a crowd command to control the movement of boom 20 and stick 24 of the crowd mechanism to further control the movement of ground engaging tool 24. The crowd command indicates a desired rate of actuation of boom 20 and stick 22 to control the movement of ground engaging tool 24 in a vertical direction and in a horizontal direction relative to vertical axis 34 (i.e. closer to or further away from vertical axis 34). The crowd command may be determined by combining the desired vertical movement with the desired horizontal movement. Control 40 may supply the crowd command to work implement 18 simultaneously with the swing command or at any point after the swing command has been initiated.

Control 40 may determine the vertical component of the crowd command based upon the characteristics of the particular job site. For example, ground engaging tool 24 may need to be elevated from a digging location to above ground level before the ground engaging tool 24 may be moved towards dumping location 78. In addition, ground engaging tool 24 may need to be elevated to a dumping height to dump load 26 at dumping location 78.

Control 40 may determine the horizontal component of the crowd command to reduce the cycle time of work machine 10. Control 40 may base the horizontal component of the crowd command on the velocity at which swing assembly 16 is moving, or is expected to move, ground engaging tool 24. For example, control 40 may calculate the horizontal component of the crowd command to move ground engaging tool 24 from a current position towards a predetermined end point, which may be, for example, dumping location 78. The projected movement path of ground engaging tool 24, indicated as a travel path 74, may coincide with a straight line that connects current position 80 and dumping location 78. For the purposes of the present disclosure, travel path 74 may be considered to be a vertical plane connecting current position 80 with dumping location 78. In other words, ground engaging tool 24 may be considered to be following travel path 74 even though the vertical height of ground engaging tool 24 varies as ground engaging tool 24 is moved to dumping location 80.

Figure 4:
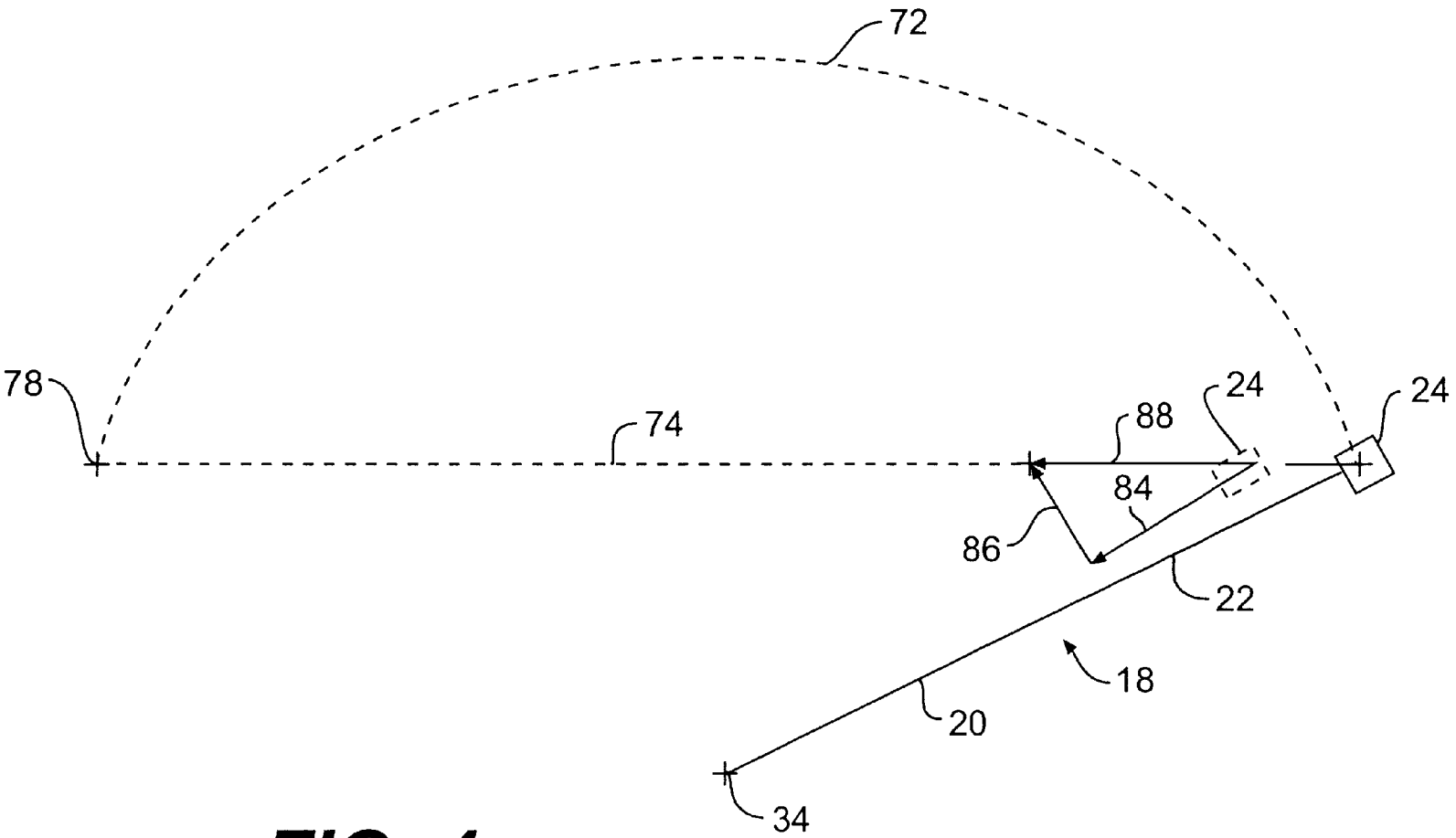
FIG. 4 is an exemplary diagrammatic representation of the forces exerted on a ground engaging tool and the resulting directions of movement as the ground engaging tool is moved towards a predetermined end point.

As illustrated in FIG. 4, the movements of swing assembly 16 and the crowd mechanism combine to move ground engaging tool 24 along travel path 74. As shown, work implement 18 moves ground engaging tool 24 in a direction indicated by arrow 84, i.e. closer to vertical axis 34. Swing assembly 16 moves ground engaging tool 24 in a direction indicated by arrow 86, which is substantially perpendicular to the movement of the crowd mechanism. The combination of the crowd movement and the swing movement yield a resultant movement 88 of ground engaging tool 24. Control 40 may calculate the desired crowd and swing movements such that resultant movement 88 lies along travel path 74.

While the foregoing discussion has described the use of position sensors to monitor the velocity and direction of ground engaging tool 24 for use in determining the crowd command, one skilled in the art will recognize that other types of sensors and/or feedback may be used to determine the crowd command. For example, a series of force sensors, or a combination of force and position sensors, may be used. The illustration in FIG. 4 may also be viewed as a force diagram, where the force exerted on ground engaging tool 24 by the crowd mechanism is depicted as arrow 84 and the force exerted on ground engaging tool 24 by swing mechanism 18 is depicted as arrow 86. The crowd and swing commands may be calculated so that the resultant of the crowd and swing forces lies along travel path 74.

Control 40 may adjust one or both of the crowd command and swing command based on the actual movement of ground engaging tool 24. Control 40 may transmit an initial crowd command to the crowd mechanism to accelerate ground engaging tool 24 towards dumping location 80. As ground engaging tool 24 moves in response to the crowd command, control 40 may continue to monitor the position, velocity, and/or acceleration rate of ground engaging tool 24. If control 40 determines that the movement of ground engaging tool 24 is directed towards a location other than dumping location 80, control 40 may adjust the crowd command to re-direct the movement of ground engaging tool 24 towards dumping location 80.

By actuating swing assembly 16, boom 20, and stick 22 to move ground engaging tool 24 along travel path 74 between the two locations, control 40 may reduce the cycle time of work machine 10. With reference to FIGS. 3 and 4, for example, if control 40 were to only actuate swing assembly 16, the acceleration of ground engaging tool 24 would be tangential to the swing path and ground engaging tool 24 would follow an arcuate path 72 to dumping location 78. Arcuate path 72 is longer than travel path 74. Accordingly, assuming that maximum velocities and acceleration rates remain constant, less time will be required to move ground engaging tool 24 along travel path 74 than arcuate path 72. Thus, following travel path 74 will reduce the cycle time for work machine 10. The reduction in time for each cycle will result in the machine being able to complete more cycles and move more earth over the course of a work day.

In addition, by moving ground engaging tool 24 along travel path 74, work machine 10 may generate a greater acceleration of ground engaging tool 24 along travel path 74 than along arcuate path 72. When ground engaging tool 24 is moved along arcuate path 72, only swing force 86 acts to accelerate ground engaging tool 24. When, however, work implement 18 is actuated to exert crowd force 84 on ground engaging tool 24, the resultant force may be greater than swing force 86 alone. Accordingly, ground engaging tool 24 will accelerate along travel path 74 at a greater rate than along arcuate path 72.

In addition, movement of boom 20 or stick 22 will act to move ground engaging tool 24 closer to the vertical axis 34, thereby reducing the moment arm of work implement 18. If swing assembly 16 exerts a constant torque on work implement 18, a shorter moment arm will result in a greater swing force 86 being applied to ground engaging tool 24. Thus, the resultant force on ground engaging tool 24 may be greater and may result in a greater acceleration when moving along travel path 74 than arcuate path 72. The greater acceleration will allow ground engaging tool 24 to reach its maximum velocity in a shorter period of time, thereby reducing the amount of time required to reach dumping location 78.

Moving ground engaging tool 24 along travel path 74 will also decrease the amount of time required to stop ground engaging tool 24 at dumping location 78. Each of boom actuator 28, stick actuator 30, and tool actuator 32 may be used to apply a deceleration force to ground engaging tool 24. These combined forces will result in a quicker deceleration of ground engaging tool 24. Thus, ground engaging tool 24 may travel at its maximum velocity for a greater portion of travel path 74 and may, therefore, arrive at dumping location 78 in a reduced amount of time.

The cycle time advantages provided by moving ground engaging tool 24 along travel path 74 may be particularly apparent in dredging operations. In such an operation, ground engaging tool 24 may be partially or completely submerged and a significant force may be required to accelerate and move the ground engaging tool 24 towards dumping location 78. Because swing assembly 16 is not usually capable of creating as great a force as work implement 18, ground engaging tool 24 will typically be raised out of the water prior to starting the swinging movement towards dumping location 78. When, however, stick actuator 30 and/or boom actuator 28 are used to help initiate movement of ground engaging tool 24 along travel path 74, the resultant force may be great enough to accelerate ground engaging tool 24 directly towards dumping location 78 while ground engaging tool 24 remains partially or completely submerged. Thus, the initial movement of ground engaging tool 24 may be towards dumping location 78 and not upwardly to lift the ground engaging tool out of the water. This will act to further reduce the cycle time in a dredging operation.

Once ground engaging tool 24 arrives at dumping location 78, control 40 may operate tool actuator 32 to dump the load of earth into a removal vehicle. Control 40 may then return ground engaging tool 24 along travel path 74 to loading location 80 to retrieve another load of earth. Alternatively, control 40 may be instructed to move ground engaging tool 24 to a second loading location 82.

If control 40 is instructed to move ground engaging tool 24 to second loading location 82, control may supply a crowd command and a swing command calculated to move ground engaging tool 24 along a second travel path 76 between dumping location 78 and second loading location 82. As described previously, control 40 may attempt to align second travel path 76 with a straight line connecting dumping location 78 and second loading location 82. If, however, moving ground engaging tool 24 along a straight line will interfere with a safety zone 70 around work machine 10, control 40 may deviate second travel path 76, such as, for example, by reducing or reversing crowd movement 84 to generate an arcuate section 77 to avoid safety zone 70. In this manner, control 40 will move ground engaging tool 24 along the shortest possible path between dumping location 78 and second loading location 82, while preventing ground engaging tool 24 from interfering with the safe operation of work machine 10.

Industrial Applicability

As will be apparent from the foregoing description, the present invention provides a control system that may reduce the cycle time of a work machine. The control system governs the movement of the work implement to move the ground engaging tool from a current position towards a predetermined end position. As a result, the work implement may move the ground engaging tool along the shortest possible path between a loading location and a dumping location. By coordinating the movements of the swing assembly, boom, and stick to move the ground engaging tool towards the dumping location, the control may reduce the amount of time required to move the ground engaging tool between the loading location and the dumping location. By reducing the amount of time required to travel between the loading location and dumping location, the present invention increases the amount of work that may be performed by the work machine in a given period of time.

The control system of the present invention may be implemented as a part of a completely automated system or as part of a semi-automated system. An operator may initiate the control system through an interface provided in the cab of the machine or an automated control system may initiate the described procedure. In either case, the control system of the present invention may be implemented into an existing work machine with only minor modifications and will not require the addition of any expensive hardware.

It will be apparent to those skilled in the art that various modifications and variations can be made in the control system of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A method of controlling a work implement having a ground engaging tool, comprising:

supplying a swing command to a swing assembly to move the ground engaging tool about a vertical axis;

determining a crowd command based on the velocity of the swing assembly, the crowd command calculated to generate a resulting net movement of the ground engaging tool toward a predetermined end point; and supplying the crowd command to a crowd mechanism to move the ground engaging tool towards the predetermined end point.

2. The method of claim 1, wherein the crowd mechanism moves the ground engaging tool towards the vertical axis and the swing assembly moves the ground engaging tool in a direction that is substantially perpendicular to the direction of movement of the crowd mechanism, and the horizontal component of the resulting movement of the ground engaging tool is along a travel path that substantially aligns with a straight line connecting the location of the ground engaging tool with the predetermined end point.

3. The method of claim 1, further including adjusting the crowd command when the ground engaging tool is moving to ensure that the resulting movement of the ground engaging tool is directed toward the predetermined end point.

4. The method of claim 1, further including receiving an instruction from an operator to move the ground engaging tool to the predetermined endpoint.

5. The method of claim 1, further including identifying the predetermined end point.

6. The method of claim 5, wherein the identifying step includes moving the ground engaging tool to the predetermined end point and sensing the position of the ground engaging tool when the ground engaging tool is at the predetermined end point.

7. The method of claim 5, wherein the identifying step includes inputting the coordinates of the predetermined end point into a control.

8. The method of claim 1, wherein the crowd mechanism includes a boom and a stick and at least one of the boom and the stick are actuated in response to the crowd command.

9. The method of claim 1, further including adjusting the crowd command to avoid moving the ground engaging tool through a predetermined zone.

10. A work machine, comprising:

a traction device;

a housing mounted on the traction device;

a work implement having a ground engaging tool and operatively connected to the housing;

a swing assembly adapted to rotate the ground engaging tool about a vertical axis;

a crowd mechanism adapted to move the ground engaging tool radially relative to the vertical axis; and a control adapted to supply a swing command to the swing assembly to move the ground engaging tool about the vertical axis, to determine a crowd command based on the velocity of the swing assembly, and to supply the crowd command to the crowd mechanism, wherein the crowd command is calculated to generate a resulting net movement of the ground engaging tool toward a predetermined end point.

11. The work machine of claim 10, wherein the swing assembly is disposed between the housing and the traction device.

12. The work machine of claim 10, further including a hydraulic system having at least one hydraulic actuator operatively connected to the swing assembly and at least one hydraulic actuator operatively connected to the crowd mechanism.

13. The work machine of claim 12, wherein the crowd mechanism includes a boom and a stick and the hydraulic system includes at least one hydraulic actuator operatively connected to the boom and at least one hydraulic actuator operatively connected to the stick.

14. The work machine of claim 13, further including a position sensing system having at least one sensor operatively connected to the ground engaging tool, the stick, the boom, and the swing assembly.

15. The work machine of claim 10, wherein the control includes a memory configured to store the coordinates of the predetermined end point and an input device configured to receive instructions from an operator.

16. The work machine of claim 10, wherein the control is adapted to deviate the movement of the ground engaging tool to prevent the ground engaging tool from interfering with a predetermined zone.

17. An apparatus for controlling a work implement having a ground engaging tool, comprising:

a swing assembly adapted to rotate the ground engaging tool about a vertical axis;

a crowd mechanism adapted to move the ground engaging tool radially relative to the vertical axis; and a control adapted to supply a swing command to the swing assembly to move the ground engaging tool about the vertical axis, to determine a crowd command based on the velocity of the swing assembly, and to supply the crowd command to the crowd mechanism, wherein the crowd command is calculated to generate a resulting net movement of the ground engaging tool toward a predetermined end point.

18. The apparatus of claim 17, further including a memory configured to store the location of the predetermined end point.

19. The apparatus of claim 17, further including a position sensing system having a series of sensors operatively connected to the work implement.

20. The apparatus of claim 17, wherein the control is configured to deviate the movement of the ground engaging tool to prevent the ground engaging tool from interfering with a predetermined zone.

* * * * *